US007637402B2

(12) United States Patent
Romanov et al.

(10) Patent No.: US 7,637,402 B2
(45) Date of Patent: Dec. 29, 2009

(54) DISPENSING CAP WITH CENTER CHANNEL AND HELICAL FLOW PROFILE

(75) Inventors: Sergey Romanov, Cranston, RI (US); Clifford Skillin, Blackstone, MA (US); Patrick J. Brannon, Warwick, RI (US)

(73) Assignee: Polytop Corporation, Slatersville, RI (US)

( * ) Notice: Subject to any disclaimer, the term of this patent is extended or adjusted under 35 U.S.C. 154(b) by 0 days.

(21) Appl. No.: 11/753,707

(22) Filed: May 25, 2007

(65) Prior Publication Data

US 2008/0054026 A1 Mar. 6, 2008

Related U.S. Application Data

(60) Provisional application No. 60/824,322, filed on Sep. 1, 2006.

(51) Int. Cl.
*B65D 47/00* (2006.01)
*B01F 5/06* (2006.01)

(52) U.S. Cl. ..... 222/547; 222/564; 222/459; 366/339

(58) Field of Classification Search ..... 222/145.5, 222/145.6, 547, 556, 557, 562, 546, 564, 222/563, 477, 575, 519, 520, 521, 571, 459; 220/254.3, 254.4, 254.5, 259.1, 259.2; 239/489, 239/500, 501, 122, 502, 523, 518; 366/339, 366/341; 138/42, 37, 38

See application file for complete search history.

(56) References Cited

U.S. PATENT DOCUMENTS 330,545 A 11/1885 Barker (Continued)

FOREIGN PATENT DOCUMENTS

DE 4214548 11/1993

(Continued)

OTHER PUBLICATIONS

PCT Notification of Transmittal of International Search Report and the Written Opinion of the International Searching Authority, or the Declaration for International Application No. PCT/US07/77520.

(Continued)

*Primary Examiner*—Kevin P Shaver
*Assistant Examiner*—Stephanie E Tyler
(74) *Attorney, Agent, or Firm*—Barlow, Josephs & Holmes, Ltd.

(57) ABSTRACT

A dispensing closure for viscous fluids contains a closure body, a closure lid and a living hinge structure hingeably connecting the closure lid to the closure body. The closure body includes an upper deck, a skirt configured and arranged to mount to a product container, and a flow conduit extending through the upper deck to provide a flow path from an interior of the closure to an exterior of the closure. The flow conduit includes an entrance orifice and an exit orifice, and an inner wall extending between the entrance orifice and the exit orifice. To provide the desired flow effect, the inner wall includes at least one flow inhibitor structure, such as helically threaded flights extending at least partially inwardly from the inner wall into the flow path to define an unobstructed central flow path and a partially obstructed peripheral flow path.

6 Claims, 4 Drawing Sheets

U.S. PATENT DOCUMENTS

| | | | | | |
|---|---|---|---|---|---|
| 1,844,442 | A | | 2/1932 | Schmalz | |
| 2,130,749 | A | | 9/1938 | Von Till | |
| 2,313,031 | A | | 3/1943 | Parkhurst | |
| 2,704,174 | A | * | 3/1955 | Uxa | 222/571 |
| 3,055,526 | A | | 9/1962 | Plunkett | |
| 3,117,821 | A | * | 1/1964 | Mylting | 406/191 |
| 3,241,722 | A | * | 3/1966 | Nissen | 222/136 |
| 3,618,170 | A | | 11/1971 | Owens | |
| 3,690,496 | A | | 9/1972 | Gibson | |
| 3,734,332 | A | | 5/1973 | Grulich | |
| 3,784,045 | A | | 1/1974 | Komendowski | |
| 3,827,593 | A | | 8/1974 | Kramb et al. | |
| 3,877,598 | A | * | 4/1975 | Hazard | 215/224 |
| 4,209,485 | A | | 6/1980 | Greenspan | |
| 4,343,754 | A | | 8/1982 | Wilde et al. | |
| 4,448,334 | A | * | 5/1984 | Morris | 222/230 |
| 4,564,113 | A | | 1/1986 | Mendler | |
| 4,579,241 | A | | 4/1986 | Hayes | |
| 4,598,844 | A | * | 7/1986 | Morris | 222/196.2 |
| 4,649,013 | A | | 3/1987 | Yamamoto et al. | |
| 4,767,587 | A | | 8/1988 | Towns et al. | |
| 4,880,140 | A | | 11/1989 | Solomon et al. | |
| 5,033,655 | A | | 7/1991 | Brown | |
| 5,048,723 | A | | 9/1991 | Seymour | |
| 5,123,575 | A | | 6/1992 | Li | |
| 5,271,531 | A | | 12/1993 | Rohr et al. | |
| 5,285,913 | A | | 2/1994 | Morton | |
| 5,292,020 | A | | 3/1994 | Narin | |
| 5,472,122 | A | | 12/1995 | Appleby | |
| 5,512,228 | A | | 4/1996 | Adams et al. | |
| 5,547,091 | A | * | 8/1996 | Neveras et al. | 215/237 |
| 5,819,994 | A | | 10/1998 | Leipold | |
| 5,820,807 | A | | 10/1998 | Urmston | |
| 5,875,909 | A | | 3/1999 | Guglielmini | |
| 6,006,960 | A | | 12/1999 | Gross | |
| 6,523,720 | B1 | | 2/2003 | Robbins, III | |
| 6,609,694 | B2 | | 8/2003 | Francois et al. | |
| 6,644,620 | B2 | | 11/2003 | Johnson | |
| 6,688,501 | B2 | * | 2/2004 | DeGroot et al. | 222/556 |
| 6,837,402 | B2 | | 1/2005 | Cardia | |
| 7,128,227 | B2 | * | 10/2006 | Skillin et al. | 215/235 |
| 7,198,162 | B2 | | 4/2007 | Francois et al. | |
| 2004/0079766 | A1 | | 4/2004 | Kokubo | |
| 2004/0245290 | A1 | | 12/2004 | Hagihara | |
| 2005/0072788 | A1 | | 4/2005 | Lieberman et al. | |
| 2005/0167455 | A1 | | 8/2005 | Yim | |
| 2006/0175357 | A1 | | 8/2006 | Hammond | |

FOREIGN PATENT DOCUMENTS

| | | |
|---|---|---|
| JP | 2004001836 | 1/2004 |
| WO | WO9513220 | 5/1995 |

OTHER PUBLICATIONS

PCT International Search Report for International Application No. PCT/US07/77520.

PCT Written Opinion for International Application No. PCT/US07/77520.

* cited by examiner

DISPENSING CAP WITH CENTER CHANNEL AND HELICAL FLOW PROFILE

CROSS REFERENCE TO RELATED APPLICATION

This application is related to and claims priority from earlier filed provisional patent application Ser. No. 60/824,322 filed Sep. 1, 2006 and incorporated herein by reference.

BACKGROUND OF THE INVENTION

The instant invention relates to container closures, and more particularly to squeeze-type container dispensing closures.

There are two major trends occurring in the design of dispensing containers and closures. The first trend is a focus on providing a "clean pour" during dispensing of the product. Many food products, such as mustard and ketchup have a high viscosity and require the user to both tip and squeeze the container to dispense the product. Past dispensing closures tended to leak product onto the top deck of the closure after dispensing, creating a messy appearance and often requiring cleaning to reseal the closure. The current emphasis in "clean pour" design is on creating a "suck-back" effect as pressure is released from the container to draw the product back into the closure.

A second trend is a growing number of dispensing containers and closures being designed so that they can be stored in an inverted position, i.e. cap down. In this regard, the product is always located right at the dispensing closure for easy dispensing right from storage. This reduces the need to tip and shake the container to push the product down to the dispensing closure. There is a balance however, between having the product at the closure for dispensing and the need to prevent the product from immediately spurting out once the lid of the closure is opened.

Both of these trends have resulted in the design of dispensing closures having various types of flexible valves that facilitate both a clean pour and inverted storage. For example, a silicone valve structure is illustrated and described in U.S. Pat. No. 5,271,531. While these silicone valves have been widely accepted by both the manufacturers and the consumers, they are somewhat more difficult to manufacture, as they require several inter-fitting parts, and thus they tend to be more expensive than traditional one-piece dispensing closures.

Another perceived drawback to the silicone valve closures is that they are constructed out of two different types of plastic and thus, from a recycling standpoint, they are more difficult to recycle because the silicone valve must be separated from the plastic closure body for recycling. While this is not a major issue in the United States, at least yet, it is currently a major issue in Europe where recycling is extremely important and even mandated in some countries.

Accordingly, there is a need in the industry for a one-piece dispensing closure that provides both a "clean pour" and the ability to store the product in an inverted position without allowing the product to leak out prior to squeezing the container. In addition, there is a need for a dispensing closure with an obstructed flow profile or a dispensing closure with a center channel and helical flow profile.

Finally, there is a perceived need for a single-piece disclosure constructed from one type of plastic so that it can be easily recycled.

BRIEF SUMMARY OF THE INVENTION

The present invention provides a one-piece dispensing closure having a unique internal flow structure that provides both a "clean pour" and a sufficient flow restriction to prevent spurting.

The dispensing closure has a closure body and a closure lid connected by a living hinge structure. The closure body includes an upper deck, a flow conduit in the upper deck and an internally threaded skirt for threaded mounting on a conventional squeeze-type container.

The dispensing closure has a flow conduit with multiple embodiments. In all embodiments, an unobstructed center channel will allow the product to flow freely through the flow conduit upon squeezing while a passive flow restriction, i.e. a flow inhibitor structure provides sufficient surface area in the regions surrounding the flow conduit to creates capillary surface tension and friction with the product and thus tend to restrict the free flow of the product through the unobstructed center channel.

In the preferred embodiment, the flow conduit has an inner wall, and helically threaded flights extending inwardly into the flow conduit to define an unobstructed center channel. The unobstructed center channel having a diameter that provides a direct flow path from the interior of the container and through the flow conduit while the helically threaded flights provide a partially obstructed peripheral flow path. The surface area provided by the inner wall of the flow conduit and helical threaded flights creates a passive capillary surface attraction with the product sufficient to overcome the head pressure of the product when inverted and prevents free flow of the product out of the unobstructed center channel. Yet when a moderate amount of pressure is applied to the container, the product has an unobstructed central channel to pass through and product is easily dispensed. The combination of the helically threaded flights and center dispensing channel have also been found to provide a "suck-back" effect, withdrawing the product back into the container when pressure is released from the container. This "suck-back" effect provides a dispensing closure having a "clean-pour" dispensing characteristic.

Another object of the embodiment is to provide a dispensing closure having a sufficient flow restriction, either within the flow path or surrounding the flow path, to counter product head pressure created by either storing the product in an inverted condition, or head pressure created when an upright container is quickly inverted to dispense product.

Another object of the embodiment is to provide a flow conduit that allows product to flow freely upon squeezing while also providing a passive flow restriction.

Another object of the embodiment is to provide a direct path from an interior of the dispensing closure along with a passive capillary surface attraction with the product sufficient to overcome the head pressure when inverted.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
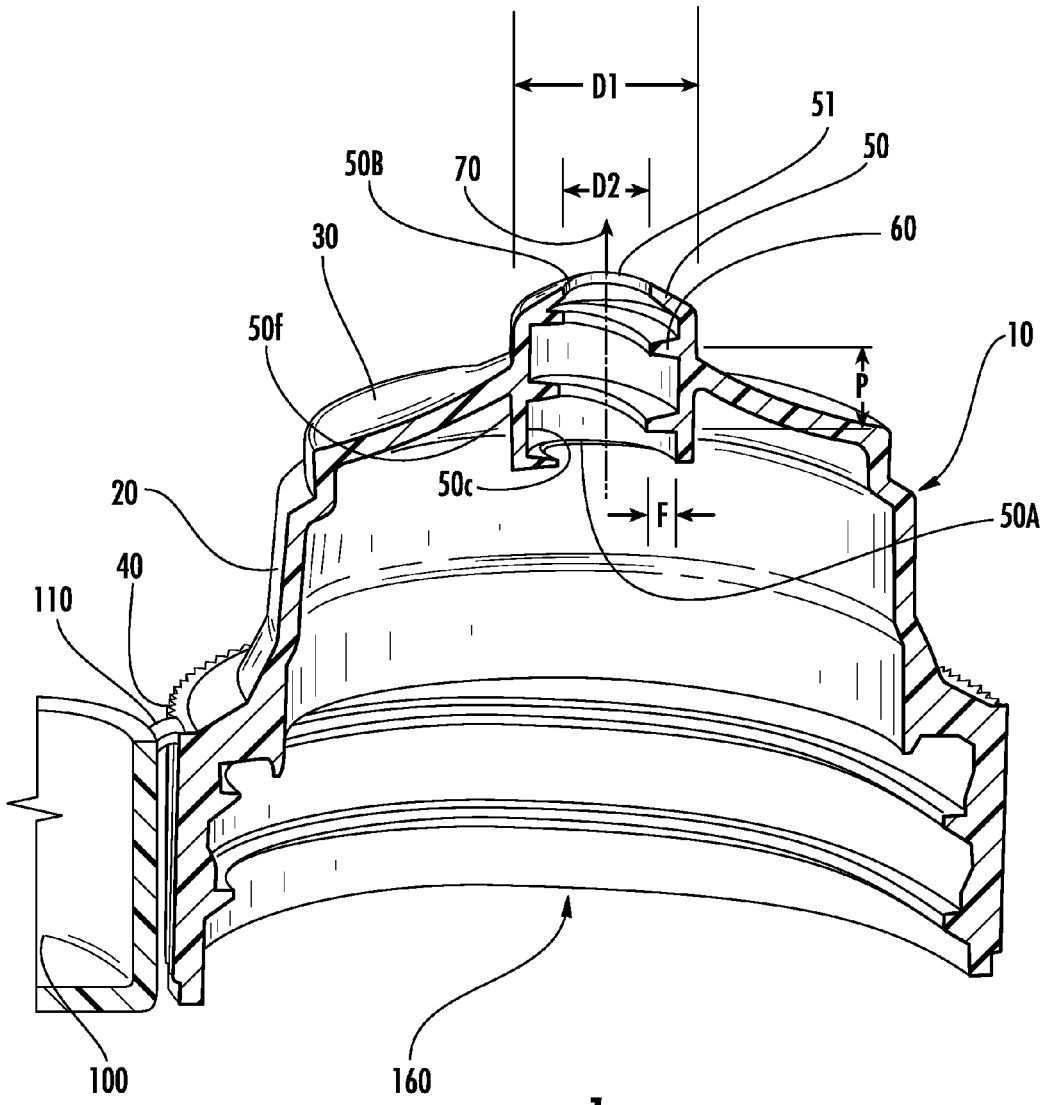
FIG. 1 is a cross-sectional view of a dispensing closure constructed with a helical flow profile.

Referring now to the drawings, the dispensing closure of the instant invention is illustrated and generally indicated at 10 in FIGS. 1, and 3-6. As will hereinafter be more fully described, the instant dispensing closure 10 includes a unique flow conduit arrangement, which includes an unobstructed central flow path and a partially obstructed peripheral flow path. This unique arrangement provides both "anti-spurting" in inverted containers as well as "suck-back" for cleaner product dispensing, i.e. "clean-pour".

Generally, each of the embodiments includes a closure body 20 having an upper deck 30, and a skirt 40 depending from the upper deck 30 where the skirt 40 is configured and arranged to mount to a product container (not shown), such as a conventional squeeze-type container. The skirt 40 is internally threaded for threaded mounting on a product container. However, it is to be understood that other skirt mounting arrangements are also contemplated within the scope of the invention, and the invention should not be limited to the inwardly threaded skirt as the only means for mounting.

Referring briefly to FIG. 1, one of the embodiments includes a closure lid 100 and a living hinge structure 110 connecting the closure lid 100 to the closure body 20. It is to be understood that any of the embodiments may optionally include a closure lid 100, and the lack of such a lid 100 in the illustrated embodiments is not to be construed as a limitation. In fact, most of the commercial embodiments will likely include a lid structure. However, for purposes of describing the preferred flow conduits, it was not necessary to show the lid in each of the illustrated embodiments.

Still referring to FIG. 1, a flow conduit 50 extends through the upper deck 30 for the passage of product, such as condiments (i.e. ketchup or mustard). The flow conduit 50 is generally defined by an inner wall 50C and an exterior wall 50F. The flow conduit 50 has an entrance orifice 50A and an exit orifice 50B.

In order to define an unobstructed central flow path and a partially obstructed peripheral flow path, the closure 10 is provided with at least one inhibitor structure extending at least partially inwardly from the inner wall 50C. Still referring to FIG. 1, the inner wall 50C of the flow conduit 50 has an inner diameter D1. Within the inner wall 50C, helically threaded flights 60 (flow inhibitor structure) are provided, which extend radially inward into the flow conduit 50 at a flight depth of F to define the unobstructed center channel 51. The unobstructed center channel 51 has a diameter D2 that provides an unobstructed central flow path 70 from an interior 160 of the dispensing closure 10 and through the flow conduit 50.

Figure 2A:
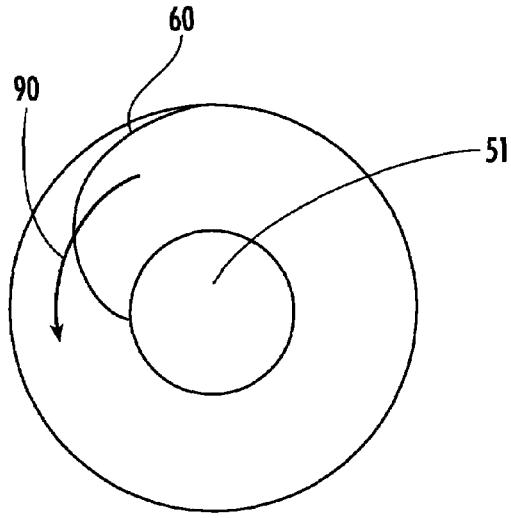
FIG. 2A is a top view of a dispensing closure constructed with a helical flow profile.

As seen in FIGS. 1 and 2A, an outer flow area between D1 and D2 defines a partially obstructed peripheral flow path 90. In this regard, product can flow through the outer flow area, i.e. it can and does spiral up the helically threaded flights 60 (see arrow 90); therefore it is defined as partially obstructed. Free flow of the product is obviously curtailed by the helically threaded flights 60.

In operation, in an inverted product container, the surface area provided by the interior wall 50C of the flow conduit 50 and the helically threaded flights 60 creates a passive capillary surface attraction with the product sufficient to overcome the head pressure of the product when inverted and prevents free flow of the product out of the unobstructed center channel 51. Accordingly, the product will not immediately spurt out of the container when first opened. Yet when a moderate amount of pressure is applied to the container, the product has an unobstructed central channel 51 to pass through and product is easily dispensed. The combination of the helically threaded flights 60 and the unobstructed center channel 51 have also been found to provide a "suck-back" effect, withdrawing the product back into the container when pressure is released from the container. The "suck-back" phenomenon effectively keeps the product off of the upper deck 30 of the closure 10, and keeps the closure 10 clean during use. Looking at possible alternative embodiments, more than one helically threaded flight 60, such as a double helix thread, may be provided.

Before proceeding with a description of other embodiments, it is important to note that the desired effect of the flow conduit 50 can only be achieved with viscous products. For example, ketchup and mustard are considered to be viscous. Obviously, the invention would not work properly when attempting to dispense water. The invention is also considered to be useful for dispensing honey and maple syrup, which are slightly less viscous. However, the geometry of the structures would need to be modified for proper dispensing thereof, the key being that the designer would need to adjust the size of the unobstructed central channel 51 and adjust the surface area of the flow obstructions to achieve the right balance of flow obstruction.

Figure 2B:
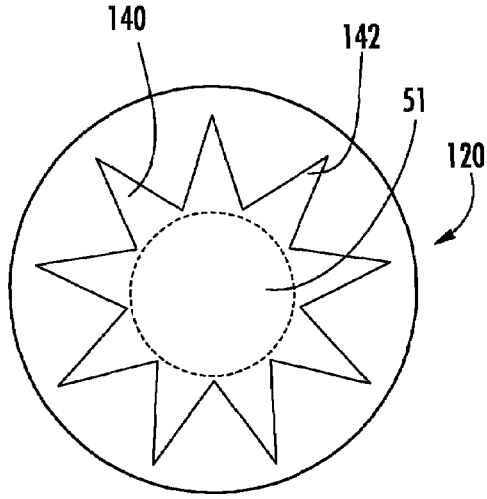
FIG. 2B is a top view of a dispensing closure constructed with a star pattern flow profile.

Referring to FIG. 2B, the helically threaded flights 60 can be replaced with a star profile 120, also containing an unobstructed center channel 51. In this embodiment, a peripheral flow path 140 is created in the gaps between the star points, with the side surfaces 142 of the star walls providing the capillary surface area.

Figure 2C:
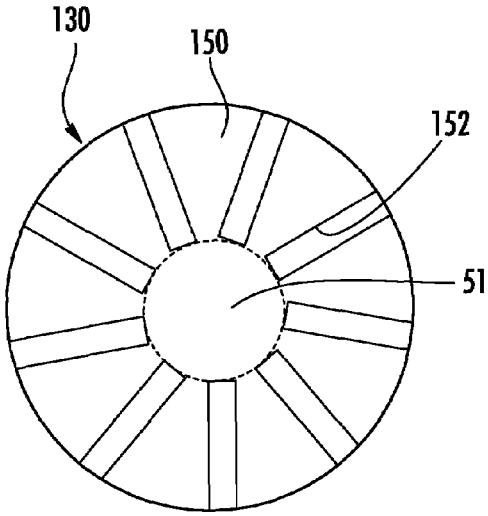
FIG. 2C is a top view of a dispensing closure constructed with a spoke pattern flow profile.

In another alternative embodiment, as illustrated in FIG. 2C, the helically threaded flights 60 can be replaced with a spoke profile 130 containing an unobstructed center channel 51. In this embodiment, a partially obstructed peripheral flow path 150 is created in the gaps between the spokes with the side surfaces 152 of the spoke walls providing capillary surface area. Both the star profile 120 and the spoke profile 130 create a capillary surface tension and friction with the product and restrict free flow of the product along their respective flow paths (140,150).

Figure 3:
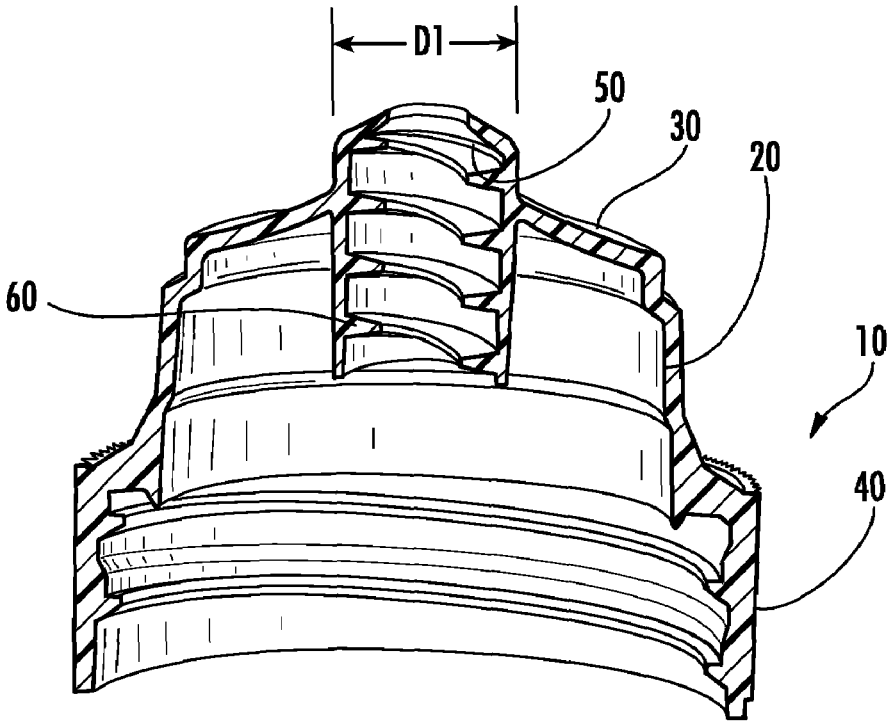
FIG. 3 is a cross-sectional view of a dispensing closure with an elongated inner wall of the fluid conduit.
Figure 4:
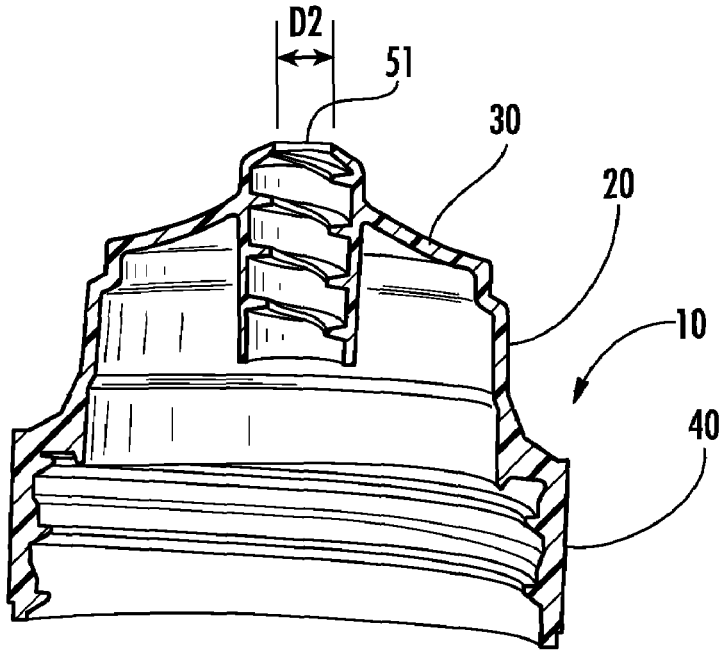
FIG. 4 is a cross-sectional view of a dispensing closure with a smaller inner diameter D2 of the center channel than shown in FIG. 1.
Figure 5:
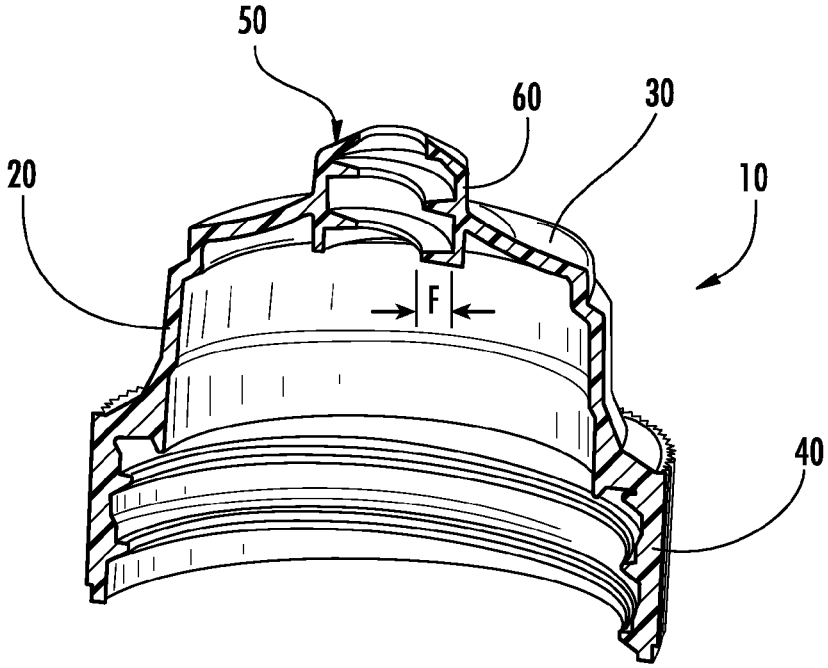
FIG. 5 is a cross-sectional view of a dispensing closure with a larger flight depth F of the helically threaded flights than shown in FIG. 1.
Figure 6:
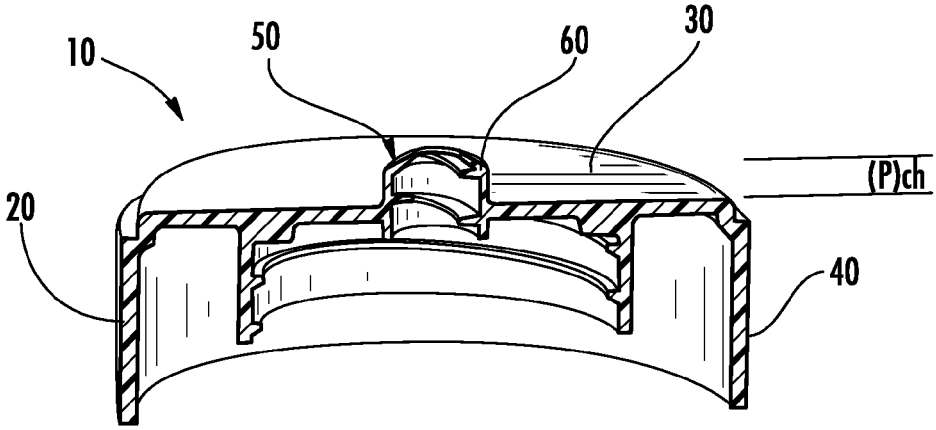
FIG. 6 is a cross-sectional view of a dispensing closure with a smaller pitch P of the thread pattern than shown in FIG. 1.

It can therefore be seen that the invention is adaptable to a range of products having varying viscosity by varying the dimensions of the dispensing closure 10. The variable dimensions of the dispensing closure 10 include: the diameter D1 of the inner wall 50C (as illustrated in FIG. 3); the inner diameter D2 (as illustrated in FIG. 4) of the unobstructed center channel 51; the flight depth F (as illustrated in FIG. 5) of the helically threaded flights 60; and the pitch P (as illustrated in FIG. 6) of the helically threaded flights 60. For example, lower viscosity products, such as syrup, will require more surface area than high viscosity products, such as mustard.

It is noted that for all of the embodiments in FIGS. 1-6, the pitch P of the helically threaded flights 60 may match the skirt threads to facilitate removal of the closure 10 from an injectable mold.

Accordingly, the embodiments above provide a dispensing closure 10 that does not include a valve structure. Also, the embodiments provide a one-piece dispensing closure 10 having a "clean-pour" dispensing characteristic. In addition, the embodiments provide a one-piece dispensing closure 10 having a sufficient flow restriction to counter product head pressure created by storing the product in an inverted condition. Most importantly, the embodiment provides a direct path from an interior of the dispensing closure 10 along with a passive capillary surface attraction with the product sufficient to overcome the head pressure when inverted.

It would be appreciated by those skilled in the art that various changes and modifications can be made to the illustrated embodiments without departing from the spirit of the embodiments. All such modifications and changes are intended to be covered by the appended claims.

What is claimed is:

1. A dispensing closure comprising: a closure body; a closure lid; and a living hinge structure hingeably connecting said closure lid to said closure body, said closure body including an upper deck, a skirt depending from the upper deck, said skirt being configured and arranged to mount to a product container, and a flow conduit extending through said upper deck to provide a flow path from an interior of said closure to an exterior of said closure, said flow conduit including an entrance orifice and an exit orifice, said flow conduit having an inner wall extending between said entrance orifice and said exit orifice, said inner wall including at least one flow inhibitor structure, said flow inhibitor structure comprising at least one helically threaded flight extending at least partially inwardly from said inner wall into said flow path to define an unobstructed central flow path and a partially obstructed peripheral flow path.

2. The dispensing closure of claim 1, wherein said flow inhibitor structure comprises first and second helically threaded flights.

3. The dispensing closure of claim 1, wherein said flow inhibitor structure comprises a plurality of walls extending inwardly from said inner wall.

4. The dispensing closure of claim 1, wherein said helically threaded flight is downwardly depending from said upper deck.

5. The dispensing closure of claim 1, wherein said helically threaded flight is upwardly and downwardly depending from said upper deck.

6. The dispensing closure of claim 1, wherein said helically threaded flight creates a capillary surface attraction within the peripheral flow path with a dispensed product sufficient to prevent free flow of said dispensed product, without applied pressure on the container.

* * * * *